US010363591B2

(12) United States Patent
Badegruber et al.

(10) Patent No.: US 10,363,591 B2
(45) Date of Patent: Jul. 30, 2019

(54) BENDING AID FOR A PRESS BRAKE

(71) Applicant: TRUMPF Maschinen Austria GmbH & Co. KG., Pasching (AT)

(72) Inventors: Karl Badegruber, Steinerkirchen (AT); Kabir Secibovic, Gunskirchen (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 429 days.

(21) Appl. No.: 15/126,627

(22) PCT Filed: Mar. 16, 2015

(86) PCT No.: PCT/AT2015/050066
§ 371 (c)(1),
(2) Date: Nov. 11, 2016

(87) PCT Pub. No.: WO2015/139066
PCT Pub. Date: Sep. 24, 2015

(65) Prior Publication Data
US 2017/0080469 A1 Mar. 23, 2017

(30) Foreign Application Priority Data
Mar. 19, 2014 (AT) ..... A 50193/2014

(51) Int. Cl.
*B21D 5/02* (2006.01)
*B21D 5/00* (2006.01)
*B21D 43/10* (2006.01)

(52) U.S. Cl.
CPC ..... *B21D 5/0281* (2013.01); *B21D 5/002* (2013.01); *B21D 5/02* (2013.01); *B21D 43/105* (2013.01)

(58) Field of Classification Search
CPC ..... B21D 5/02; B21D 5/002; B21D 5/0281; B21D 43/105
(Continued)

(56) References Cited

U.S. PATENT DOCUMENTS 3,855,840 A * 12/1974 Kawano ..... B21D 5/0281 72/389.3
4,114,418 A * 9/1978 Jarman ..... B21D 5/0281 72/386
(Continued)

FOREIGN PATENT DOCUMENTS

AT 387 736 B 3/1989
CN 101668597 A 3/2010
(Continued)

OTHER PUBLICATIONS

International Search Report of PCT/AT2015/050066, dated Jul. 29, 2015.
(Continued)

*Primary Examiner* — David B Jones
(74) *Attorney, Agent, or Firm* — Collard & Roe, P.C.

(57) ABSTRACT

The invention relates to a support device (15) for a press brake, comprising a base frame (24) and a support plate (17) with a bearing surface (18) which can be positioned between a base position (26) and a maximum position (27). The support plate (17) is arranged on a lever linkage system (25) which is connected to a drive unit (32) and which is designed as a parallel kinematics system. The drive unit (32) comprises a crank (35), which is connected to a positioning drive (33) designed as a rotary drive (34), and a rocker (54), which is connected to the crank in an articulated manner. The rocker (54) is connected to the crank (35) by means of an eight rotary joint (55) and to the lever linkage system (25) by means of a ninth rotary joint (56).

16 Claims, 6 Drawing Sheets

(58) Field of Classification Search
USPC ..... 72/420
See application file for complete search history.

(56) References Cited

U.S. PATENT DOCUMENTS

| | | | | | |
|---|---|---|---|---|---|
| 4,341,104 | A * | 7/1982 | Jarman | B21D 5/0281 | 72/389.3 |
| 4,594,870 | A * | 6/1986 | Koyama | B21D 5/0281 | 72/20.5 |
| 4,706,491 | A * | 11/1987 | Sartorio | B21D 5/0281 | 493/18 |
| 4,753,100 | A * | 6/1988 | Hanni | B21D 5/0281 | 700/165 |
| 5,058,406 | A * | 10/1991 | Sartorio | B21D 5/0281 | 414/590 |
| 5,187,958 | A * | 2/1993 | Prunotto | B21D 5/002 | 72/16.2 |
| 5,761,940 | A * | 6/1998 | Moore, Jr. | B21D 5/002 | 72/19.4 |
| 6,301,949 | B1 * | 10/2001 | Beddoe | B21D 5/02 | 100/218 |
| 6,634,204 | B2 * | 10/2003 | Gascoin | B21D 5/0281 | 100/215 |
| 6,823,708 | B1 * | 11/2004 | Okubo | B21D 5/0281 | 700/114 |
| 6,938,454 | B2 * | 9/2005 | Strasser | B21D 5/02 | 414/225.01 |
| 7,802,456 | B2 * | 9/2010 | Ikeda | B21D 5/02 | 72/16.2 |
| 8,833,131 | B2 | 9/2014 | Reiter et al. | | |

FOREIGN PATENT DOCUMENTS

| | | | |
|---|---|---|---|
| CN | 102228918 | A | 11/2011 |
| DE | 41 26 906 | A1 | 2/1993 |
| DE | 91 16 617 | U1 | 4/1993 |
| EP | 0 325 841 | A2 | 8/1989 |
| EP | 0 542 610 | B1 | 8/1997 |
| JP | S52-135164 | A | 11/1977 |
| JP | S52-147136 | U | 11/1977 |
| JP | S 56-148417 | A | 11/1981 |
| JP | S 60-261624 | A | 12/1985 |
| JP | H 01-122619 | A | 5/1989 |
| JP | H 01-122621 | A | 5/1989 |
| JP | H 01-181919 | A | 7/1989 |
| JP | 2001-276929 | A | 10/2001 |

OTHER PUBLICATIONS

Austrian Search Report dated Jan. 23, 2015 in AT A 50193/2014 with English translation of relevant parts.

* cited by examiner

BENDING AID FOR A PRESS BRAKE

This application is the National Stage of PCT/AT2015/050066 filed on Mar. 16, 2015, which claims priority under 35 U.S.C. § 119 of Austrian Application No. A 50193/2014 filed on Mar. 19, 2014, the disclosures of which are incorporated by reference. The international application under PCT article 21(2) was not published in English.

The invention relates to a support device for a press brake, as described in claim 1.

From EP 0 542 610 B1 and DE 41 26 906 A1 support devices are known which are provided to support the sheet metal workpiece to be bent on a press brake during the bending process. The support device can be attached in this case onto the front side of a press brake. On the support device a support plate is formed on which the sheet metal workpiece to be bent can rest, in particular the section of the sheet metal workpiece projecting from the press brake. If the sheet metal workpiece is moved upwards during the bending process, the support plate is also carried, so that during the whole bending process the projecting section of the sheet metal workpiece is supported. The parallel kinematic system is designed in this case such that the pivot axis of the support plate is essentially congruent with the bending axis of the sheet metal workpiece, so that the surface of the bearing plate can be guided parallel to the surface of the sheet metal workpiece. The movement mechanics of the support device is formed in this case by a parallel kinematic system, which can be moved by means of a hydraulic or pneumatic cylinder. The parallel kinematic system comprises individual lever arms, which are connected to one another and to a base frame by means of rotary joints. On the parallel kinematic system a support plate with a bearing surface is also arranged.

The disadvantage of the embodiments known from EP 0 542 610 B1 and DE 41 26 906 A1 is that the support device is designed to be very large, whereby for the machine operator only a very restricted standing space is available. Furthermore, by means of the shown structure there is a high mass inertia of the individual elements, whereby a highly dynamic mode of operation required in modern press brakes is not possible or is only possible in some circumstances.

The underlying objective of the present invention is to provide an improved support device, which is adjusted to the dynamic mode of operation of a modern press brake and can handle highly dynamic positioning movements.

Said objective of the invention is achieved by the measures according to claim 1.

According to the invention a support device is formed for a press brake comprising a base frame, at least one connecting plate arranged on the base frame for securing the support device onto a press brake, by means of which connecting plate a perpendicular connecting plane is formed, a support plate with a bearing surface. The support plate can be positioned between a base position and a maximum position, wherein the support plate is arranged on a lever linkage system, which is connected to a positioning drive and designed as a parallel kinematic system. The lever linkage system comprises a first main lever arm with a first and a second rotary joint and a second main lever arm with a third and a fourth rotary joint, which are arranged parallel to one another and by means of the first and the third rotary joint, which lie in a main bearing plane, are mounted on the base frame. On the two main lever arms a support arm is mounted by means of the second and fourth rotary joint, wherein a standard interval between the first and second rotary joint is the same size as a standard interval between the third and fourth rotary joint. The second and fourth rotary joints are also spaced apart from the coupling plane like the first and third rotary joint. On the support arm the support plate is mounted by means of a fifth rotary joint, which fifth rotary joint is arranged on a part of the support arm projecting over the fourth rotary joint. The support plate is connected by means of a sixth rotary joint to a support arm, which support arm is connected parallel to the support arm by means of a seventh rotary joint to the first or the second main lever arm. The seventh rotary joint is arranged in extension of the straight line between the first and second rotary joint or between the third and fourth rotary joint. The drive unit comprises a crank connected to the positioning drive, which is designed as a rotary drive and a rocker connected by articulation to the latter, which rocker is connected by means of an eighth rotary joint to the crank and by means of a ninth rotary joint to the lever linkage system.

A surprising advantage of the design according to the invention is that the known advantages of a lever linkage system can be achieved in the form of a parallel kinematic system can be achieved and in addition an improved dynamic in the mode of operation of the support device and a small amount of installation space can be achieved by the positioning drive. It is an advantage in this case that the positioning drive can be positioned so that it keeps the installation space of the support device particularly small. By means of an advantageous articulation of the lever linkage system by means of the positioning drive it is possible to that the radial forces acting on the rotary joints can also be reduced as the forces occurring due to the mass inertia and the acceleration of the individual parts can be minimized. In this way the whole support device can have a reduced mass, whereby an increase dynamic mode of operation is possible.

Furthermore, it can be an advantage that the rocker is connected by means of the ninth rotary joint to the support arm of the lever linkage system. By connecting the rocker onto the support arm of the lever linkage system it is possible that the lever linkage system can have an advantageous translation for the conversion of the drive movement into a movement of the support plate. Thus a comparably small drive movement of the positioning drive can be converted with only a small drive path into a comparatively large movement path of the support plate, wherein the forces applied by the positioning drive, which are caused particularly due to the dynamic loading, can be maintained In one development the pendulum support can be connected at a section of the support arm projecting over the second rotary joint. It is an advantage in this case that the aforementioned improved dynamic properties can be achieved particularly easily by means of this configuration.

Furthermore, it is possible that the crank, in particular a connecting line between the center of rotation of the positioning drive and eighth rotary joint, in the basic position of the support plate are arranged at an acute angle between 1° and 20°, preferably between 2° and 10°, in particular between 4° and 8° to the rocker, in particular to a connecting line between the eighth and ninth rotary joint, and in that the crank and the rocker are arranged in the maximum position of the support plate at an acute angle between 160° and 179°, preferably between 170° and 178°, in particular between 172° and 176° to one another. It is an advantage in this case that in this way in the two end positions a rotary movement of the positioning drive at a specific angle speed leads to a smaller linear speed on the lever linkage system than a rotary movement of the positioning drive with the same angle speed in an intermediate position. It behaves in exactly the opposite way with the forces to be applied by the positioning drive. In other words the positioning drive in the basic position and in the maximum position of the lever linkage system with only a small torque load can applied a high linear force on the lever linkage system, as the crank and rocker behave like a toggle lever. The highest forces occur particularly in these two end positions, as the dynamic forces caused by the mass inertia of the lever linkage systems reach a maximum. Furthermore, in this way the mass accelerations can be reduced, since as already mentioned also the speeds or the speed profile is improved by the positioning drive.

Furthermore, it is possible that the crank of the positioning drive in the base position of the support plate is rotated so that the crank is arranged, in particular a connecting line between the center of rotation of the positioning drive and eighth rotary joint, at an angle between 180° and 270°, preferably between 190° and 250°, in particular 220° and 240° to the connecting plane. It is an advantage here that by means of this arrangement the crank is positioned so that with as little installation space as possible the crank can be accommodated advantageously and the transmitted forces and the travelling movement can be configured advantageously.

Furthermore it is possible that the crank of the positioning drive is rotated in the maximum position of the support plate so that the crank is arranged, in particular a connecting line between the center of rotation of the positioning drive and eighth rotary joint, at an angle between 0° and 45°, preferably between 5° and 20°, in particular between 7° and 15° relative to the connecting plane. It is an advantage in this case that by means of this arrangement the crank is positioned so that with as little installation space as possible the crank can be accommodated advantageously and the transmitted forces and the driving movements can be configured advantageously.

An embodiment is also advantageous according to which the positioning drive comprises a servomotor. In particular a servomotor is good for using in such a machine as it can produce a high torque, a holding force, or even a standstill torque, and thus does not have to be braked. Furthermore, a servomotor can be controlled precisely in its travelling movement and position so that a precise positioning of the support plate is possible. Such a servomotor can also be controlled easily by the machine control.

Furthermore, it is possible that the support arm is spaced apart further from the main bearing plane than the support arm. It is an advantage in this case that in this way the support arm is arranged in the lever linkage system so that it is mounted in a space-saving manner.

According to one development it is possible that an adjusting device is arranged between the connecting plate and base frame, by means of which the base frame can be adjusted relative to its position to the connecting plate parallel to the connecting plane in a vertical direction. It is an advantage in this case that in this way the support device is height-adjustable. In this way different bending tools with different support heights of the bending die can be used in the press brake, wherein the support device, in particular the support plate can be adjusted in its base position to the vertical position of the sheet metal.

In one development it is possible that the adjusting device comprises a drive motor. It is an advantage in this case that by means of a drive motor the adjusting movement of the base frame relative to the connecting plate can be automated.

Furthermore, it can be advantageous that the support device comprises a protective cover, wherein the protective cover consists of a fixed section and a section moved with the support plate, and the first main lever arm and/or the support arm has at least in some sections an external contour adapted to the internal contour of the protective cover, in particular a circular arc-shaped external contour. It is an advantage in this case that by means of the protective cover the movable parts of the lever linkage system are protected from interference, and in this way the risk of injury to a user can be reduced. Furthermore, by means of the protective cover the inner components are protected from environmental effects and dirt. As the individual elements of the lever linkage system are adapted to the protective cover, the protective cover can be made to be as small as possible, whereby installation space is saved and also the mass to be moved can be kept as small as possible.

Furthermore, it is possible that the distance of the fifth rotary joint from the sixth rotary joint is between 25% and 60%, preferably between 35% and 50%, in particular between 40% and 45% of the distance of the first rotary joint to the second rotary joint and that the fourth rotary joint has the same distance from the fifth rotary joint, as the first rotary joint from the second rotary joint. The surprising advantage here is that in combination with the rotary drive a configuration of the lever linkage system can be achieved in which the installation space is as small as possible and also the forces occurring in the rotary joints can be kept as low as possible, as the dynamic forces can be kept as low as possible due to the mass inertia of the individual components. In this way the lever linkage system can be adjusted highly dynamically.

Furthermore, it is possible that the distance of the ninth rotary joints from the seventh rotary joint is between 5% and 30%, preferably between 10% and 25%, in particular between 15% and 20% of the distance of the first rotary joint from the second rotary joint and that the distance of the eighth rotary joint from the ninth rotary joint is between 110% and 145%, preferably between 120% and 135%, in particular between 125% and 130% of the distance of the first rotary joint to the second rotary joint, and that the distance of the center of rotation of the positioning drive from the eighth rotary joint is between 45% and 75%, preferably between 50% and 60%, in particular between 54% and 64% of the distance of the first rotary joint to the second rotary joint. It is a surprising advantage that in combination with the rotary drive a configuration of the lever linkage system can be achieved in which the installation space is as small as possible and also the forces occurring in the rotary joints can be kept as low as possible, as the dynamic forces can be kept as low as possible due to the mass inertia of the individual components. In this way the lever linkage system can be adjusted highly dynamically.

In addition, it is possible that the distance of the first rotary joint from the third rotary joint is between 25% and 60%, preferably between 35% and 50%, in particular between 40% and 45% of the distance of the first rotary joint to the second rotary joint, and that the horizontal distance of the first rotary joint from the third rotary joint is between 15% and 40%, preferably between 20% and 35%, in particular between 25% and 30% of the distance of the first rotary joint from the second rotary joint and that the horizontal distance of the center of rotation of the positioning drive to the third rotary joint is between 35% and 65%, preferably between 40% and 60%, in particular between 45% and 55% of the distance of the first rotary joint to the second rotary joint. A surprising advantage of this is that in combination with the rotary drive a layout of the lever linkage system can be achieved in which the installation space is as small as possible and also the forces occurring in the rotary joints can be kept as small as possible, as the dynamic forces can be kept as low as possible due to the mass inertia of the individual components. In this way the lever linkage system can be adjusted highly dynamically.

For a better understanding of the invention the latter is explained in more detail with reference to the following Figures.

In a much simplified, schematic representation:

Figure 1:
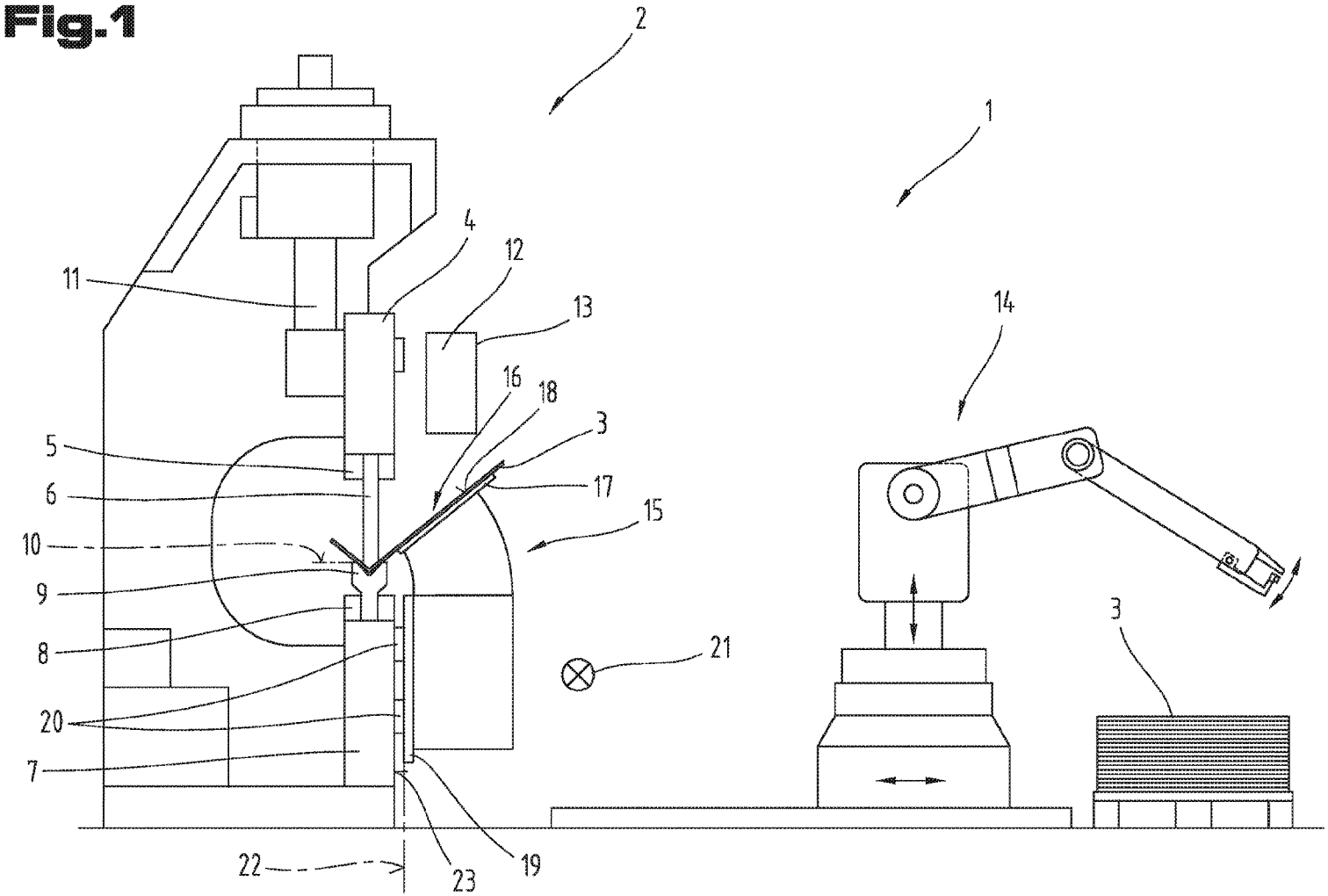
FIG. 1 shows a side view of a processing system with a press brake and a support device.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows in a schematic view the side view of a processing system 1. The processing system 1 comprises a press brake 2, which is provided for bending a sheet metal 3.

The press brake 2 comprises a first adjustable pressing bar 4, in which a first tool holder 5 is formed for mounting a first bending tool 6. The first bending tool 6 is preferably designed here as a bending punch 6. Furthermore, the press brake 2 comprises a second fixed pressing bar 7 on which a second tool holder 8 is formed for mounting a second bending tool 9. The second bending tool 9 is preferably designed as a bending die and corresponds with the first bending tool 6.

The sheet metal 3 to be bent is placed on a sheet metal supporting surface 10 of the second bending tool 9. The first bending tool 6 or the first adjustable pressing bar 4 is moved upwards or downwards by a press drive unit 11 in vertical direction. To control the press drive unit 11 a computer unit 12 is provided which can be coupled to an input and/or display unit 13.

Furthermore, it is possible for the processing system 1 to comprise a manipulation device 14, by means of which the sheet metals 3 to be processed can be manipulated automatically. Alternatively to this, it is also possible that the sheet metals 3 to be processed can be placed manually into the press brake 2.

In order to process large sheet metal workpieces 3, a support device 15 can be attached to the press brake 2, which can support a sheet metal leg 16 of the sheet metal 3 to be processed which projects out relative to the bending tool 6, 9 during the bending process. In this way it is possible to prevent the projecting sheet metal leg 16 from bending downwards due to its inherent mass and due to gravity and thus from deforming unintentionally.

The support device 15 comprises a support plate 17, on which a bearing surface 18 is formed. The sheet metal 3 to be processed can lie on the bearing surface 18 and is guided and supported during the bending process by the support device 15. The support device 15 also comprises a connecting plate 19 by means of which the support device 15 can be secured onto the press brake 2.

In this way there are several ways of connecting the connecting plate 19 to the press brake 2. For example, the connecting plate 19 can be connected to the press brake 2 by means of a guide rail system, which is designed as a linear guide 20. By means of such a linear guide 20 it is possible that the support device 15 is adjustable in a horizontal direction 21. The adjustment of the support device 15 in horizontal direction 21 can be performed as required manually or by means of a drive unit.

For example a quick coupling unit or a screw connection can be provided as an alternative fastening between the connecting plate 19 and press brake 2. In principle here all of the fastening elements known to a person skilled in the art can be used.

The transitional interface between the press brake 2 and support device 15 is represented by a connecting plane 22. Said connecting plane 22 is preferably aligned vertically in the operational state of the support device 15 and is thus parallel to an end face 23 of the front side of the press brake 2, on which the support device 15 is attached. The connecting plane 22 thus defines the alignment of the support device 15 in the operating state in which the support device 15 is secured to the press brake 2.

All of the positions, such as top, bottom etc. relate to the operation ready state of the support device 15, in which the latter is attached to the press brake 2.

Figure 2:
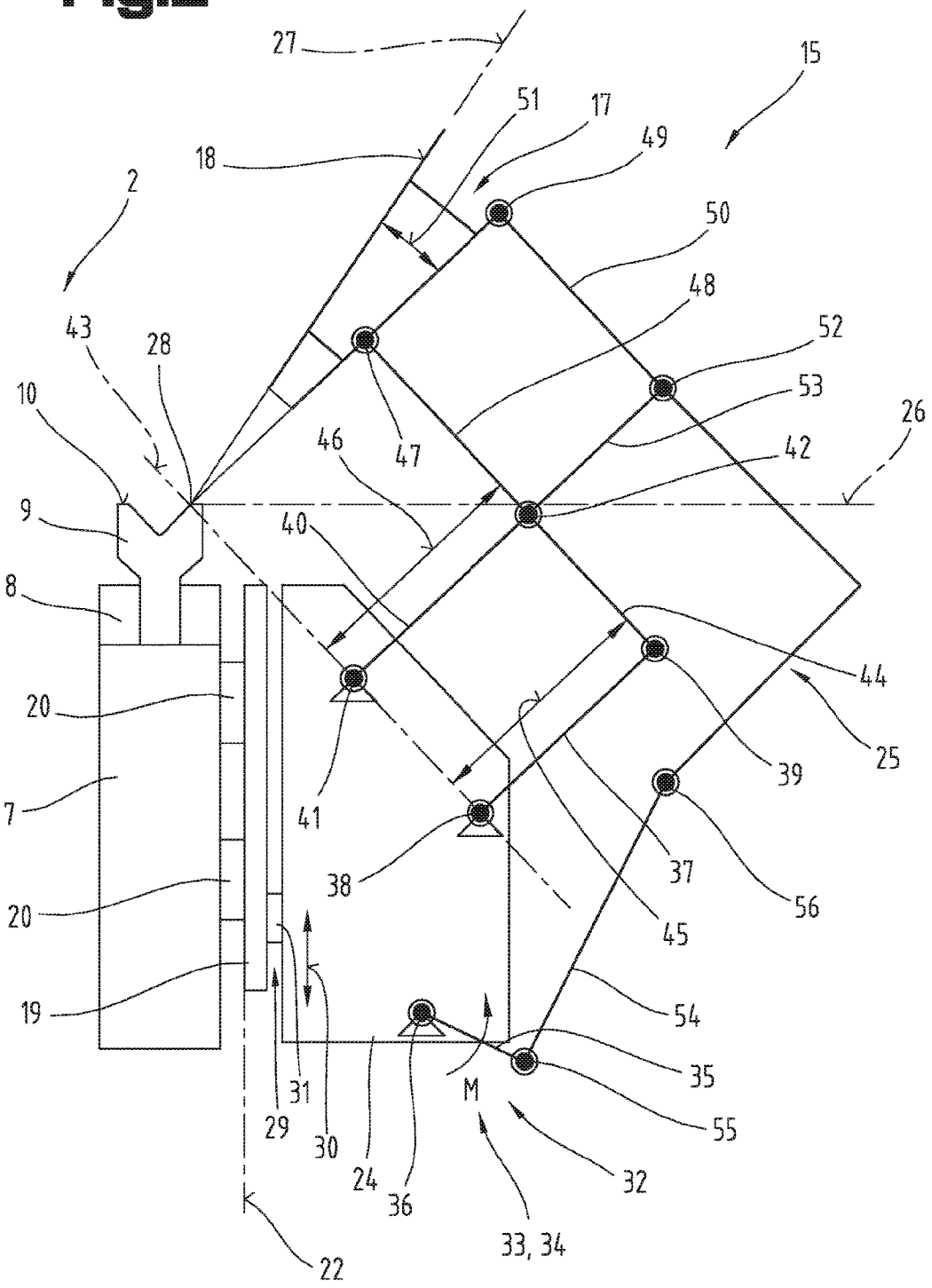
FIG. 2 shows a side view of a schematic view of a support device.

FIG. 2 shows in a side view according to FIG. 1 a schematic view of the support device 15 according to the invention by means of which its functioning and structure is explained and described.

The support device 15 is illustrated by simplified dashes which illustrates the central lines of the individual levers.

The support device 15 comprises a base frame 24, on which a lever linkage system 25 is arranged and on which lever linkage system 25 the support plate 17 is secured. By means of such a lever linkage system 25 it is possible that the support plate 17, in particular its bearing surface 18, can be pivoted between a basic position 26 and a maximum position 27. By means of the correct dimensioning of the lever linkage system 25, a pivoting center 28 of the pivot movement is congruent with the outer bearing edge of the second bending tool 9 and thus during the whole bending process or during the whole pivoting process it is ensured that the sheet metal 3 to be bent, in particular the sheet metal leg 16, bears fully on the bearing surface 18 of the support plate 17.

In order that the bearing surface 18 of the support plate 17 in its basic position 26 is on the same level as the sheet metal supporting surface 10 of the second bending tool 9, it is possible that an adjusting device 29 is attached between the connecting plate 19 and base frame 24 by means of which the base frame 24 can be adjusted in a vertical direction 30. This is necessary if various different bending tools 9 are used which have different dimensions. The adjusting device 29 can be driven manually here by a crank. In a further embodiment variant it is also possible to provide a drive motor 31 which is coupled to the computer unit 12 and thus enables an automatic height adjustment of the support plate 17.

The base frame 24 can be constructed from profiles secured relative to one another. Furthermore, it is also possible that the base frame 24 is formed by a one-piece cast, steel component or aluminum block.

On the base frame 24 a drive unit 32 is secured which is provided for adjusting and positioning the lever linkage system 25. The drive unit 32 is preferably designed as a positioning drive 33 and comprises a rotary drive 34. Said rotary drive 34 can be provided by using a servomotor. Such a servomotor can also be coupled to a gear, in order to increase the torque or the positioning precision. The use of a servomotor has proved to be ideal as a servomotor can achieve a high degree of precision and also has a high torque. Furthermore, a servomotor can be coupled very effectively by a corresponding intermediate electrics to the computer unit 12 of the press brake 2.

The drive unit 32 also comprises a crank 35, which is rotated by the rotary drive 34 about its center of rotation 36.

The lever linkage system 25 comprises a first main lever arm 37, in which a first and a second rotary joint 38, 39 are mounted.

All of the components of the lever linkage system are described in more detail in an advantageous embodiment of the support device 15 with reference to the following Figures and description passages. For reasons of simplicity according to the functional model shown in FIG. 2 a lever arm is represented simply as a central line between two rotary joints, and such a central line is denoted as a lever arm within the meaning of this application.

The first main lever arm 37 is formed according to this description for example by a straight line, which extends from the central point of the first rotary joint 38 to the central point of the second rotary joint 39. The length of the first main lever arm 37 is seen as the standard interval between the first and second rotary joint, in particular between its central points.

Where it is mentioned that two main lever arms are in parallel with one another, this means that there is a straight line of a lever arm connecting the central points between two rotary joints, which is parallel to a second straight line of a further lever arm connecting the central points between two rotary joints.

By means of this simplified functional model used for explanation purposes however there is no restriction of the options for the configuration of a main lever arm or a lever arm. A lever arm can be designed for example due to its construction as a curved element, wherein for the function of the lever arm only the position of the rotary joints arranged in the lever arm is significant.

The first main lever arm 37 is secured by means of the first rotary joint 38 to the base frame 24. The described rotary joints can here be in the form of any type of rotary joint known to a person skilled in the art such as bolts, roller bearings etc.

The lever linkage system 25 also comprises a second main lever arm 40, on which a third rotary joint 41 and a fourth rotary joint 42 are arranged. The second main lever arm 40 is hereby secured by means of the third rotary joint 41 to the base frame 24.

The first rotary joint 38 and the third rotary joint 41 are located in this case in a main bearing plane 43. The main bearing plane 43 also runs through the pivoting center 28.

The lever linkage system 25 also comprises a support arm 44, which is connected by means of the second rotary joint 39 and the fourth rotary joint 42 to the first main lever arm 37 and the second main lever arm 40. The support arm 44 is designed so that in the installed state the first main lever arm 37 and the second main lever arm 40 are parallel to one another.

Furthermore, the support arm 44 is parallel to the main bearing plane 43. In other words the standard interval 45 between the first rotary joint 38 and the second rotary joint 39 is the same as a standard interval 46 between the third rotary joint 41 and fourth rotary joint 42.

The third rotary joint 41 is arranged here, as viewed in horizontal direction, closer to the connecting plane 22 than the first rotary joint 38. Furthermore, the third rotary joint 41 is arranged further up than the first rotary joint 38. The two main lever arms 37, 40 are oriented so that their second 39 and fourth rotary joint 42 in connection with the support arm 44 are further removed from the connecting plane 22 than their first 38 and third rotary joints 41 on the main bearing plane 43.

By means of a fifth rotary joint 47 the support plate 17 is secured onto the support arm 44. The support plate 17 is hereby attached onto a part of the support arm projecting over the fourth rotary joint 42. Furthermore, on the support plate 17 by means of a sixth rotary joint 49 a support arm 50 is arranged which ensures the stability of the support plate 17.

It is not absolutely necessary that the bearing surface 18 runs parallel to a connecting line between the fifth rotary joint 47 and sixth rotary joint 49.

As shown in FIG. 2, it can be advantageous, if the support plate 17, in particular the thus described connecting lines between fifth rotary joint 47 and sixth rotary joint 49 and an extension of the bearing surface 18, run in a wedge-shape relative to one another and thus form a support angle 51. In this way it is possible for the installation space of the support device 15 to be kept as small as possible. However, it has to be ensured that an extension of these two lines intersects in the pivoting center 28.

The support arm 50 is connected by a seventh rotary joint 52 to the first 37 or to the second main lever arm 40. The seventh rotary joint 52 is hereby positioned or the lengths of the individual lever arms are selected so that the support arm 50 runs parallel to the support arm 44. The seventh rotary joint 52 is also arranged in an extension of the straight line 53 between the first and second rotary joint 38, 39 or between the third or fourth rotary joint 41, 42.

For the functionality of the lever linkage system 25 it is not essential whether the seventh rotary joint 52 is arranged on the first main lever arm 37 or on the second main lever arm 40. By means of the described structure there is a straight line which stretches between the fifth rotary joint 47 and sixth rotary joint 49 and which runs through the pivoting center 28 and is parallel to the first and to the second main lever arm 37, 40.

In this way the virtual pivoting center 28 is formed during a pivot movement of the lever linkage system 25 between the basic position 26 and maximum position 27 of the virtual pivoting center 28.

In order to position the lever linkage system 25 by means of the drive unit 32 a rocker 54 is provided, which is connected by means of an eighth rotary joint 55 to the already described crank 35 and by means of a ninth rotary joint 56 to the lever linkage system 25.

In this case it is not important which connection point of the lever linkage system 25 the ninth rotary joint 56 is arranged on. It has been shown to be advantageous if the ninth rotary joint 56 is arranged on the support arm 50. However, it is also possible that the ninth rotary joint 56 is arranged for example on the support arm 44 or on the first or second main lever arm 37, 40.

Figure 3:
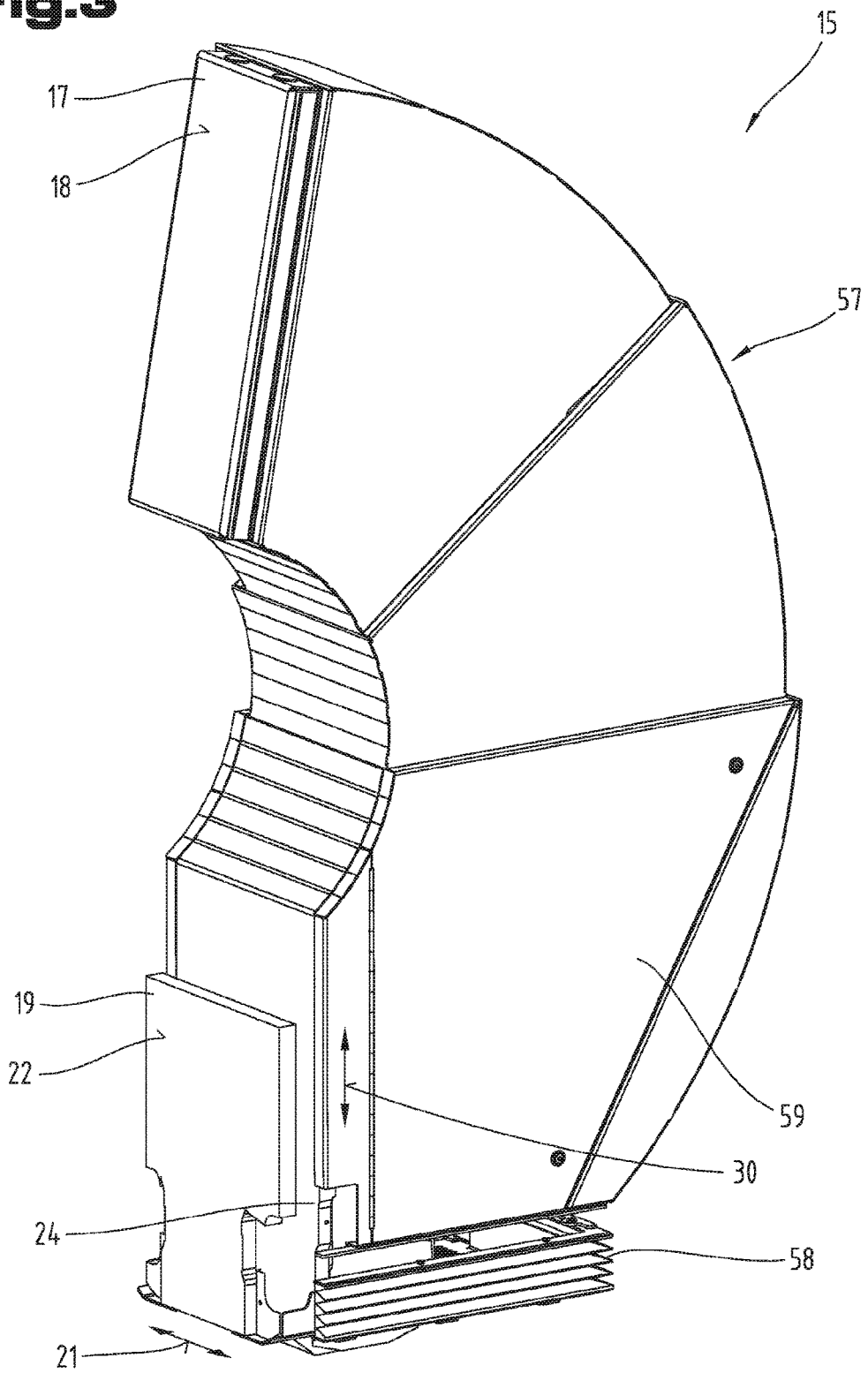
FIG. 3 shows a perspective view of an advantageous embodiment variant of a support device.

FIG. 3 shows a perspective view of a support device 15 wherein the latter is located in its maximum position 27. In this case it can be seen that a protective cover 57 is formed by means of which the inner parts, in particular the lever linkage system 25, are protected prior to engagement. The protective cover 57 is divided into several individual segments, whereby the latter can be moved telescopically with the support plate 17.

Furthermore, it is possible that at the bottom end of the support device 15 protective bellows 58 are attached which are provided to sufficiently cover the inner parts of the support device 15 during a height adjustment of the base frame 24 relative to the connecting plate 19.

Furthermore, it can be advantageous if the protective cover 57 has an openable side wall 59, through which the rotary drive 34 is accessible for maintenance purposes.

Figure 4:
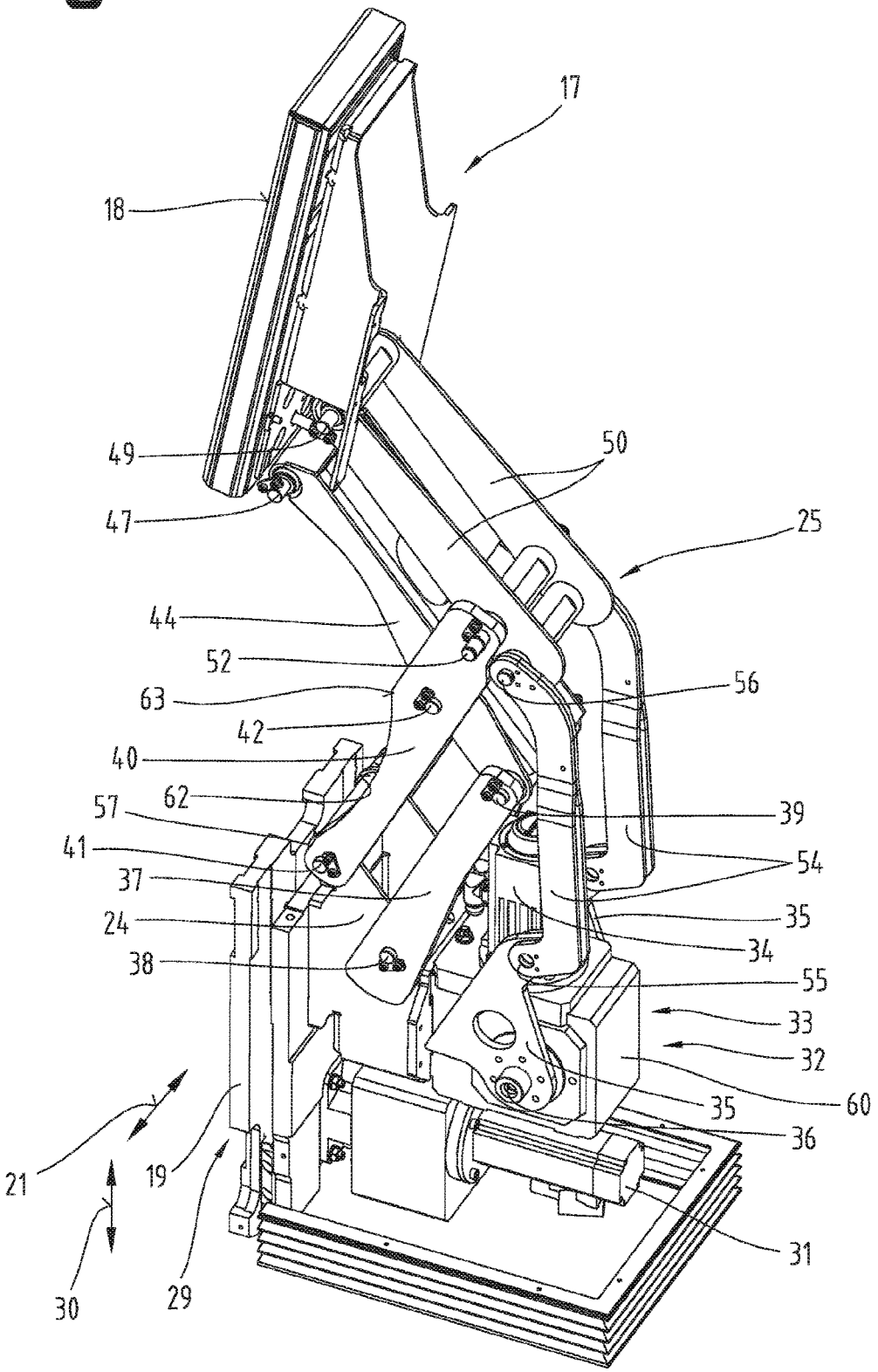
FIG. 4 shows a further perspective view of an advantageous embodiment variant of a support device with a removed protective cover.

FIG. 4 shows the support device 15 in a further perspective view, wherein in this view the protective cover 57 has been removed in order to reveal the lever linkage system 25. It is shown very clearly here that the lever linkage system 25 is not constructed in one plane, but the latter has a specific width, whereby a three-dimensional structure is formed and thus the whole system can be given a certain degree of stability.

As shown, the rotary drive 34 can be arranged on a gear 60. Said gear can have two output shafts, wherein on each of the two output shafts a crank 35 can be arranged. Said two cranks 35 can be connected to two rockers 54, which can be connected to two support arms 50.

According to the example embodiment shown here all of the individual parts of the lever linkage system 25 and the drive unit 32 are designed to have a lightweight structure as far as possible, wherein it is possible that recesses are formed inside the individual levers to achieve the lightweight structure. In order to make the whole system as small as possible, it can also be advantageous if the individual levers are not designed as simple straight components, but if the latter are designed as curved parts or have recesses in order to achieve the best possible internesting of the individual parts.

It can be advantageous if the second main lever arm 40 or the support arm 44 have at least in some sections an external contour 62 adapted to the internal contour 61 of the protective cover 57.

The individual connections referred to as rotary joints between the lever arms can be designed in the form of bolts as shown in the example embodiment, which are mounted in a slide bearing or roller bearing.

It can be advantageous if relative to the width of the system a symmetrical or mirror arrangement of the individual lever elements is selected so that there are no tensions or internal forces from the transverse movement. The individual connecting bolts are designed here preferably as through bolts, whereby an unwanted formation of torque is avoided. Only the connecting bolts between the crank 35 and rocker 54 cannot be designed as through bolts for reasons of space. It is advantageous here if either the crank 35 or the rocker 54 is designed at least partly as a fork, so that the forces occurring in the eighth rotary joint 55 can be transmitted effectively and there is no disadvantageous loading.

Figure 5:
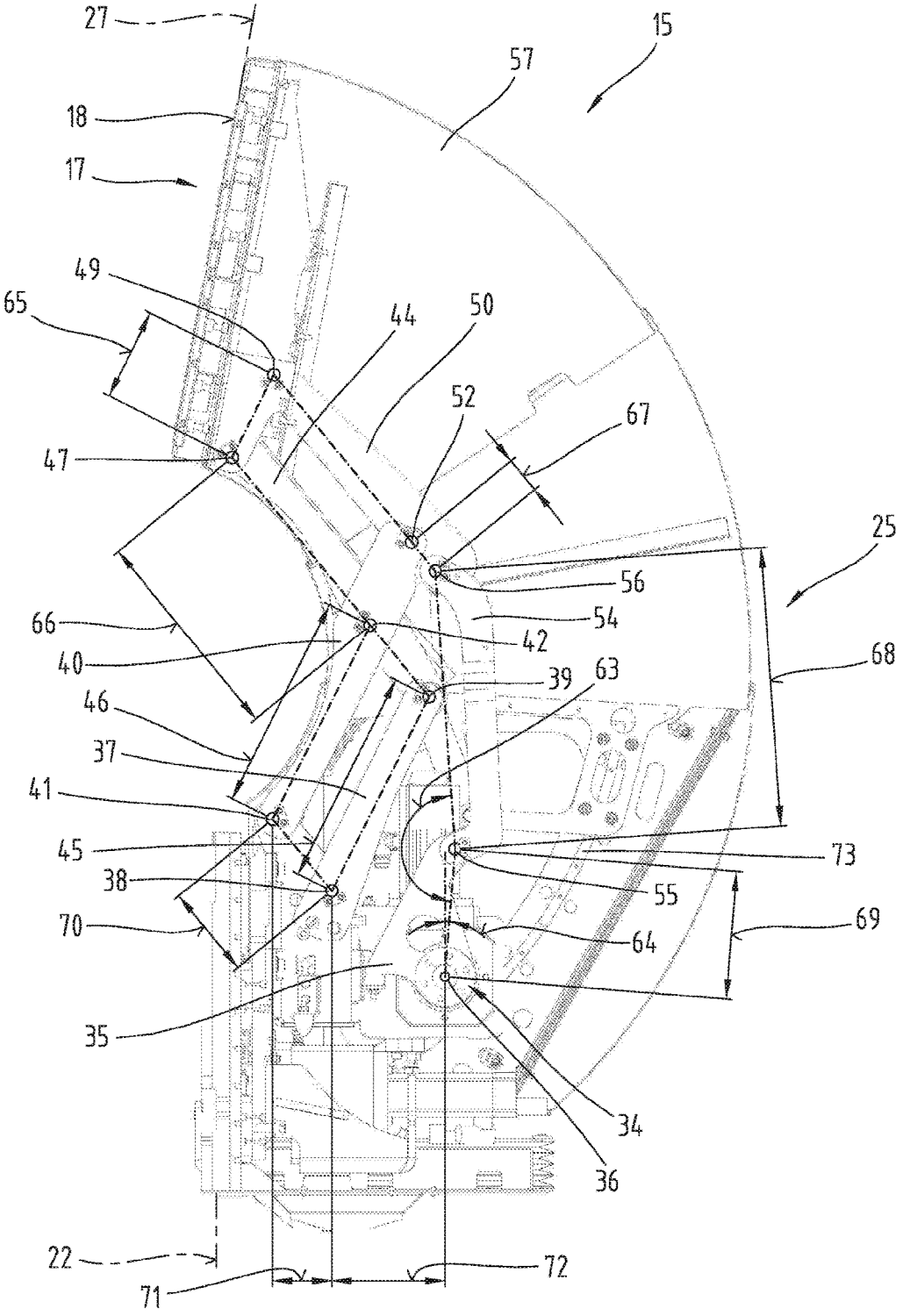
FIG. 5 shows a side view of an advantageous embodiment variant of a support device in a maximum position.
Figure 6:
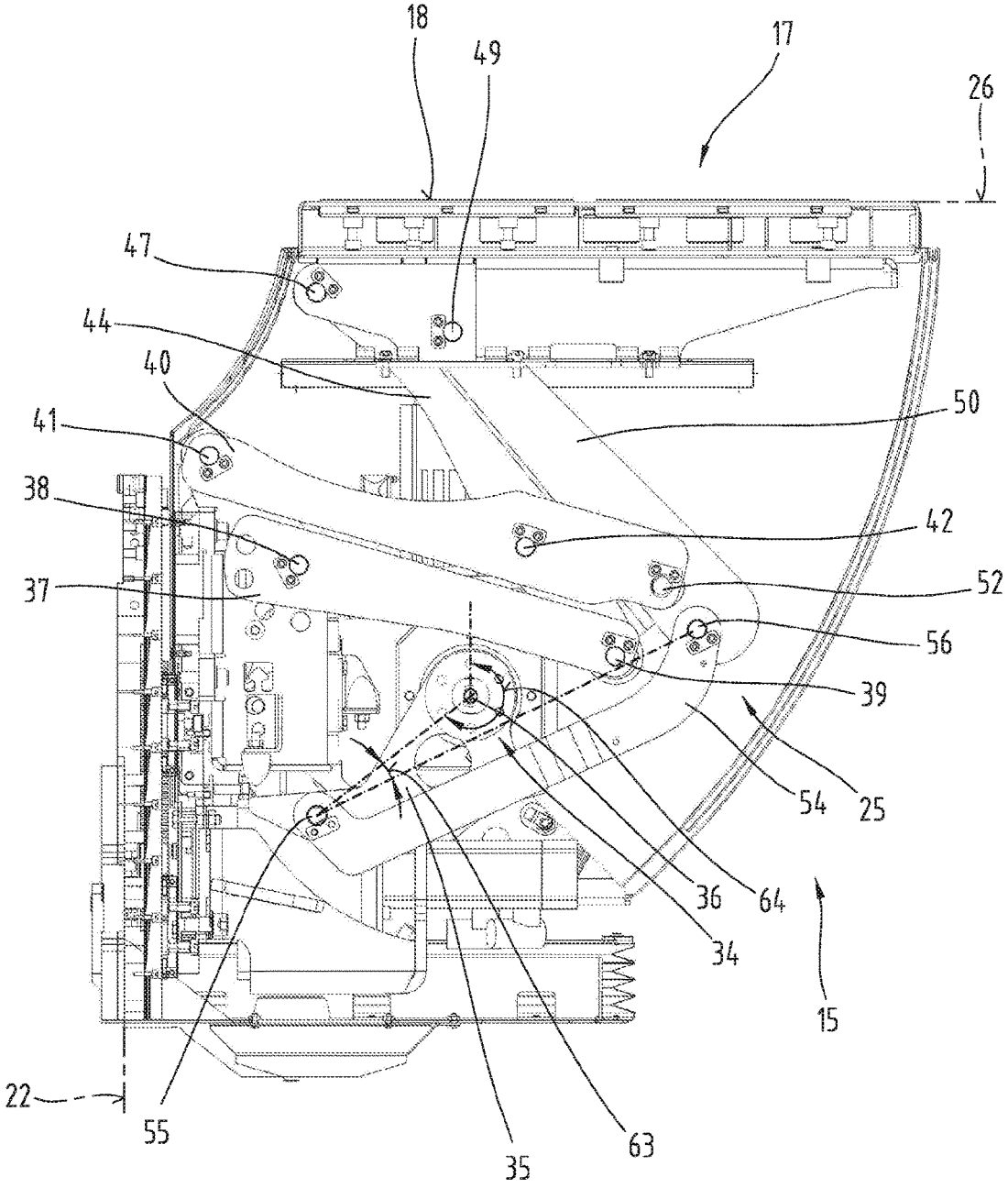
FIG. 6 shows a side view of an advantageous embodiment variant of a support device in a basic position.

The FIGS. 5 and 6 show the support device 15 in a side view, wherein the support plate 17 in FIG. 5 is in its maximum position 27 and in FIG. 6 is in its basic position 26. The advantageous dimensions of the lever linkage system 25 are shown very clearly, which are shown in this embodiment variant. The optimal value ranges of the individual lengths have already been mentioned in the description of the advantages. Particularly, in combination with the drive unit 32 according to the invention the value details of the geometry of the lever linkage system 25 result in an embodiment, in which the internal forces can be minimized and installation space can also be reduced.

An important geometric dimension is a first angle 63 between the crank 35 and rocker 54. As explained above, the connecting line is between the individual rotary joints of the geometry-relevant component. Furthermore, a second angle 64 is relevant, which extends between the crank 35 and the vertical connecting plane 22. The relevant geometric dimensions for creating the lever linkage system 25 are also the standard interval 65 between the fifth rotary joint 47 and sixth rotary joint 49, the standard interval 66 between the fourth rotary joint 42 and fifth rotary joint 47, the standard interval 67 between the ninth rotary joint 56 and seventh rotary joint 52, the standard interval 68 between the eighth rotary joint 55 and ninth rotary joint 56, the standard interval 69 between the center of rotation 36 of the rotary drive 34 and eighth rotary joint 55, the standard interval 70 between the first rotary joint 37 and second rotary joint 40, and the horizontal distance 71 between the first rotary joint 37 and third rotary joint 41 and the horizontal distance 72 between the first rotary joint 37 and center of rotation 36 of the rotary drive 34.

Furthermore, in FIGS. 5 and 6 a guide rail 73 is shown in which the individual segments of the protective cover 57 can be guided.

FIGS. 3 to 6 show a further and possibly independent embodiment of the support device 15, wherein the same reference numerals and components names have been used for the same parts as in the preceding FIGS. 1 and 2. To avoid unnecessary repetition reference is made to the detailed described of the preceding FIGS. 1 and 2

The example embodiments show possible embodiment variants of the support device 15, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, also individual features or combinations of features of the shown and described different example embodiments can represent independent solutions according to the invention.

The underlying objective of the solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1-2, 3-6 can form the subject matter of independent solutions according to the invention. The objectives and solutions according to the invention relating thereto can be taken from the detailed descriptions of these figures.

Finally, as a point of formality, it should be noted that for a better understanding of the structure of the support device 15, the latter and its components have not been represented true to scale in part and/or have been enlarged and/or reduced in size.

| List of reference numerals | |
|---|---|
| 1 | processing system |
| 2 | press brake |
| 3 | sheet metal |
| 4 | first adjustable pressing bar |
| 5 | first tool holder |
| 6 | first bending tool |
| 7 | second fixed pressing bar |
| 8 | second tool holder |
| 9 | second bending tool |
| 10 | sheet metal supporting surface |
| 11 | press drive unit |
| 12 | computer unit |
| 13 | input-display unit |
| 14 | manipulation device |
| 15 | support device |
| 16 | sheet metal leg |
| 17 | support plate |
| 18 | bearing surface |
| 19 | connecting plate |
| 20 | linear guide |
| 21 | horizontal direction |
| 22 | connecting plane |
| 23 | end face |
| 24 | base frame |
| 25 | lever linkage system |
| 26 | base position |
| 27 | maximum position |
| 28 | pivoting center |
| 29 | adjusting device |
| 30 | vertical direction |
| 31 | drive motor |
| 32 | drive unit |
| 33 | positioning drive |
| 34 | rotary drive |
| 35 | crank |
| 36 | center of rotation |
| 37 | first main lever arm |
| 38 | first rotary joint |
| 39 | second rotary joint |
| 40 | second main lever arm |
| 41 | third rotary joint |
| 42 | fourth rotary joint |
| 43 | main bearing plane |
| 44 | support arm |
| 45 | standard interval 1-2 |
| 46 | standard interval 3-4 |
| 47 | fifth rotary joint |
| 48 | protruding part |
| 49 | sixth rotary joint |
| 50 | support arm |
| 51 | support angle |
| 52 | seventh rotary joint |
| 53 | straight line |
| 54 | rocker |
| 55 | eighth rotary joint |
| 56 | ninth rotary joint |
| 57 | protective cover |
| 58 | protective bellows |
| 59 | side wall |
| 60 | gear |
| 61 | internal contour |
| 62 | external contour |
| 63 | first angle |
| 64 | second angle |
| 65 | standard interval 5-6 |
| 66 | standard interval 4-5 |
| 67 | standard interval 9-7 |
| 68 | standard interval 8-9 |
| 69 | standard interval central point-8 |
| 70 | standard interval 1-3 |
| 71 | horizontal distance 1-3 |
| 72 | horizontal distance central point-1 |
| 73 | guide |

The invention claimed is:

1. A support device for a press brake, comprising:

(a) a base frame;

(b) at least one connecting plate arranged on the base frame for securing the support device on the press brake and defining a perpendicular connecting plane;

(c) a drive unit comprising a crank;

(d) a lever linkage system connected to the drive unit and comprising a parallel kinematic system, the lever linkage system comprising a first main lever arm with a first rotary joint and a second rotary joint separated from the first rotary joint by a first standard interval and a second main lever arm with a third rotary joint and a fourth rotary joint arranged parallel to the first main lever arm, the third rotary joint being separated from the fourth rotary joint by a second standard interval, wherein the first main lever arm and the second main lever arm are mounted on the base frame by the first rotary joint and the third rotary joint, wherein the first rotary joint and the third rotary joint lie in a main bearing plane;

(e) a support plate arranged on the lever linkage system and comprising a bearing surface positionable between a first end position and a second end position;

(f) a first support arm parallel to the main bearing plane and mounted on the first main lever arm and the second main lever arm by the second rotary joint and the fourth rotary joint, the first support arm comprising a part projecting over the fourth rotary joint;

(g) a second support arm;

(h) a positioning drive comprising a rotary drive connected to the crank;

(i) a rocker joined to the rotary drive;

(j) a fifth rotary joint arranged on the part of the first support arm projecting over the fourth rotary joint; and (k) a sixth rotary joint, a seventh rotary joint, an eighth rotary joint, and a ninth rotary joint;

wherein the first standard interval between the first rotary joint and the second rotary joint is equal to the second standard interval between the third rotary joint and the fourth rotary joint and the second rotary joint and the fourth rotary joint are spaced further from the perpendicular connecting plane than the first rotary joint and the third rotary joint;

wherein the support plate is mounted on the first support arm by the fifth rotary joint;

wherein the support plate is connected by the sixth rotary joint to the second support arm;

wherein the second support arm is connected parallel to the first support arm by the seventh rotary joint to the first main lever arm or the second main lever arm and the seventh rotary joint is arranged along a straight line extending through the first rotary joint and the second rotary joint or extending through the third rotary joint and the fourth rotary joint; and wherein the rocker is connected by the eighth rotary joint to the crank and by the ninth rotary joint to the lever linkage system.

2. The support device as claimed in claim 1, wherein the rocker is connected by the ninth rotary joint to the support arm of the lever linkage system.

3. The support device as claimed in claim 2, wherein the rocker is connected on a section of the support arm projecting above the second rotary joint to the second rotary joint.

4. The support device as claimed in claim 1, wherein the crank in the first end position of the support plate is arranged at an acute angle between 1° and 20° relative to the rocker, and wherein the crank and the rocker are arranged relative to one another in the second end position of the support plate at an acute first angle between 160° and 179°.

5. The support device as claimed in claim 1, wherein the crank of the positioning drive in the first end position of the support plate is rotated so that the crank is arranged at a second angle between 180° and 270° relative to the perpendicular connecting plane.

6. The support device as claimed in claim 1, wherein the crank of the positioning drive is rotated in the second end position of the support plate so that the crank is arranged at a second angle between 0° and 45° relative to the perpendicular connecting plane.

7. The support device as claimed in claim 1, wherein the positioning drive comprises a servomotor.

8. The support device as claimed in claim 1, wherein the support arm is spaced apart further from the main bearing plane than the support arm.

9. The support device as claimed in claim 1, wherein between the connecting plate and base frame an adjusting device is arranged, wherein the base frame adjustable via the adjusting device relative to a position of the base frame to the connecting plate parallel to the perpendicular connecting plane in a vertical direction.

10. The support device as claimed in claim 9, wherein the adjusting device comprises a drive motor.

11. The support device as claimed in claim 1, wherein the connecting plate on an interface of the connecting plate to the press brake has a linear guide, so that the support device is adjustable relative to the press brake parallel to the perpendicular connecting plane in a horizontal direction.

12. The support device as claimed in claim 1, wherein the support device comprises a protective cover, wherein the protective cover comprises a fixed section and a section which can be moved with the support plate, and the first main lever arm and/or the first support arm comprises at least in sections an external contour adjusted to the internal contour of the protective cover.

13. The support device as claimed in claim 1, wherein the distance of the fifth rotary joint to the sixth rotary joint is between 25% and 60% of the distance of the first rotary joint to the second rotary joint and wherein the fourth rotary joint has the same distance from the fifth rotary joint as the first rotary joint from the second rotary joint.

14. The support device as claimed in claim 1, wherein the distance of the ninth rotary joint from the seventh rotary joint is between 5% and 30% of the distance of the first rotary joint from the second rotary joint and wherein the distance of the eighth rotary joint from the ninth rotary joint is between 110% and 145% of the distance of the first rotary joint to the second rotary joint, and wherein the distance of the center of rotation of the positioning drive from the eighth rotary joint is between 45% and 75% of the distance of the first rotary joint from the second rotary joint.

15. The support device as claimed in claim 1, wherein the distance of the first rotary joint from the third rotary joint is between 25% and 60% of the distance of the first rotary joint from the second rotary joint, and wherein the horizontal distance of the first rotary joint from the third rotary joint is between 15% and 40% of the distance of the first rotary joint from the second rotary joint and wherein the horizontal distance of the center of rotation of the positioning drive from the third rotary joint is between 35% and 65% of the distance of the first rotary joint from the second rotary joint.

16. A processing system comprising a press brake with a first adjustable pressing bar, which comprises a first tool holder and a second fixed pressing bar, which comprises a second tool holder, and a support device for supporting a sheet metal to be processed, which via at least one connecting plate can be secured onto the press brake, wherein the support device is designed according to claim 1.

* * * * *